US011747106B2

(12) United States Patent
Kung et al.

(10) Patent No.: US 11,747,106 B2
(45) Date of Patent: Sep. 5, 2023

(54) FIRING LINKAGE MECHANISM OF TOY LAUNCHER

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 13 days.

(21) Appl. No.: 17/572,912

(22) Filed: Jan. 11, 2022

(65) Prior Publication Data

US 2023/0160656 A1 May 25, 2023

(30) Foreign Application Priority Data

Nov. 22, 2021 (TW) ..... 110213819

(51) Int. Cl.

| | |
|---|---|
| ***F41B 7/08*** | (2006.01) |
| ***F41A 19/10*** | (2006.01) |
| ***A63H 29/24*** | (2006.01) |
| *F41B 11/89* | (2013.01) |

(52) U.S. Cl.

CPC ..... *F41B 7/08* (2013.01); *A63H 29/24* (2013.01); *F41A 19/10* (2013.01); *F41B 11/89* (2013.01)

(58) Field of Classification Search

CPC . F41A 19/10; F41B 7/08; F41B 11/89; A63H 29/24

USPC ..... 124/31

See application file for complete search history.

(56) References Cited

U.S. PATENT DOCUMENTS

| | | | | | |
|---|---|---|---|---|---|
| 1,759,084 | A * | 5/1930 | Baum | F41B 7/025 | 124/19 |
| 2,321,077 | A * | 6/1943 | Gora | F41B 7/003 | 124/16 |
| 2,550,873 | A * | 5/1951 | Siders | F41B 7/025 | 124/19 |
| 3,968,784 | A * | 7/1976 | Miller | F41B 7/003 | 124/31 |
| 4,800,864 | A * | 1/1989 | Small | F41B 7/025 | 124/19 |
| 5,170,770 | A * | 12/1992 | Vosloh | F41B 7/025 | 124/19 |
| 5,613,482 | A * | 3/1997 | Thai | F41B 7/003 | 124/16 |

(Continued)

*Primary Examiner* — Alexander R Niconovich

(74) *Attorney, Agent, or Firm* — Chun-Ming Shih; HDLS IPR Services

(57) ABSTRACT

A firing linkage mechanism includes a linkage assembly, a trigger assembly, and a firing assembly. The linkage assembly has a moving end and a firing end. The trigger assembly is disposed on the moving end and has a trigger portion and a connecting portion connected with the moving end. The connecting portion drives the linkage assembly to make an axial movement when the trigger portion is acting. The firing assembly is disposed on the firing end and has a touching portion and a firing portion extended from the touching portion. The firing end of the linkage assembly is disposed with an acting portion cooperating with the touching portion of the firing assembly. The acting portion is driven to move the touching portion by the axial movement of the linkage assembly to make the firing portion implement a firing action.

7 Claims, 9 Drawing Sheets

(56) References Cited

U.S. PATENT DOCUMENTS

| | | | | | |
|---|---|---|---|---|---|
| 5,884,614 | A * | 3/1999 | Darlington | F41B 5/12 | 124/35.1 |
| 6,048,280 | A * | 4/2000 | Palmer | F41B 11/71 | 124/16 |
| 7,770,567 | B1 * | 8/2010 | Yehle | F41A 17/46 | 124/40 |
| 8,770,178 | B2 * | 7/2014 | Kempf | F41A 19/10 | 124/31 |
| 8,899,218 | B2 * | 12/2014 | Kempf | F41B 5/1469 | 124/35.1 |
| 9,010,308 | B1 * | 4/2015 | Hyde | F41B 5/1469 | 124/40 |
| 9,194,646 | B2 * | 11/2015 | Victor | F41B 7/08 | |
| 9,255,754 | B1 * | 2/2016 | Kempf | F41B 5/12 | |
| 9,435,605 | B2 * | 9/2016 | McPherson | F41B 5/12 | |
| 9,612,078 | B2 * | 4/2017 | EuDaly | A63H 5/04 | |
| 9,726,454 | B2 * | 8/2017 | McPherson | F41B 5/123 | |
| 9,970,732 | B2 * | 5/2018 | Mellen | F41B 3/005 | |
| 10,209,021 | B1 * | 2/2019 | Huang | F41A 19/10 | |
| 10,215,520 | B1 * | 2/2019 | Liu | F41B 5/12 | |
| 10,215,522 | B1 * | 2/2019 | Kempf | F41B 5/12 | |
| 10,508,884 | B1 * | 12/2019 | Chen | F41A 17/46 | |
| 11,085,721 | B1 * | 8/2021 | Liu | F41B 5/12 | |
| 11,592,259 | B1 * | 2/2023 | Davis | F42B 12/382 | |

* cited by examiner

FIRING LINKAGE MECHANISM OF TOY LAUNCHER

TECHNICAL FIELD

The disclosure relates to a toy gun, particularly to a firing linkage mechanism of a toy launcher.

DESCRIPTION OF RELATED ART

In the industry of toy guns, besides simulated or imitation firearms, other real weapons such as rockets or rocket launchers may also be simulated or imitated to become toy in appearance. In addition, the toy gun industry may make modifications depending on different designs of appearance.

In the primary parts of general toy guns, besides the loading (such as the inside design of a magazine) or firing (such as firing or shooting after bullet loading) of bullets, designing parts such as triggers and firing pins associated with appearances of different simulated firearms is the most difficult part of a toy gun design. Existing parts cannot be directly applied to various simulated toy guns. More importantly, when a designer wants to simulate real weapons such as rockets or rocket launchers to be toy launchers, because the design framework of interior parts is completely different, especially the trigger and the firing position usually have to match the length of a bazooka body, those parts are not able to directly use parts of general toy guns. Thus, more costs of time and design are needed to design different toy launchers.

In view of this, the inventors have devoted themselves to the above-mentioned related art, researched intensively and cooperated with the application of science to try to solve the above-mentioned problems.

SUMMARY

An object of the disclosure is to provide a firing linkage mechanism of a toy launcher, which makes the moving position and the firing position of the toy launcher be unlimited to make more diverse modifications or changes to match different designs or production models.

To accomplish the above object, the disclosure provides a firing linkage mechanism of a toy launcher, which includes a linkage assembly, a trigger assembly, and a firing assembly. The linkage assembly has a moving end and a firing end. The trigger assembly is disposed on the moving end and has a trigger portion and a connecting portion connected with the moving end. The connecting portion drives the linkage assembly to make an axial movement when the trigger portion is acting. The firing assembly is disposed on the firing end and has a touching portion and a firing portion extended from the touching portion. The firing end of the linkage assembly is disposed with an acting portion cooperating with the touching portion of the firing assembly. The acting portion is driven to move the touching portion by the axial movement of the linkage assembly to make the firing portion implement a firing action.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
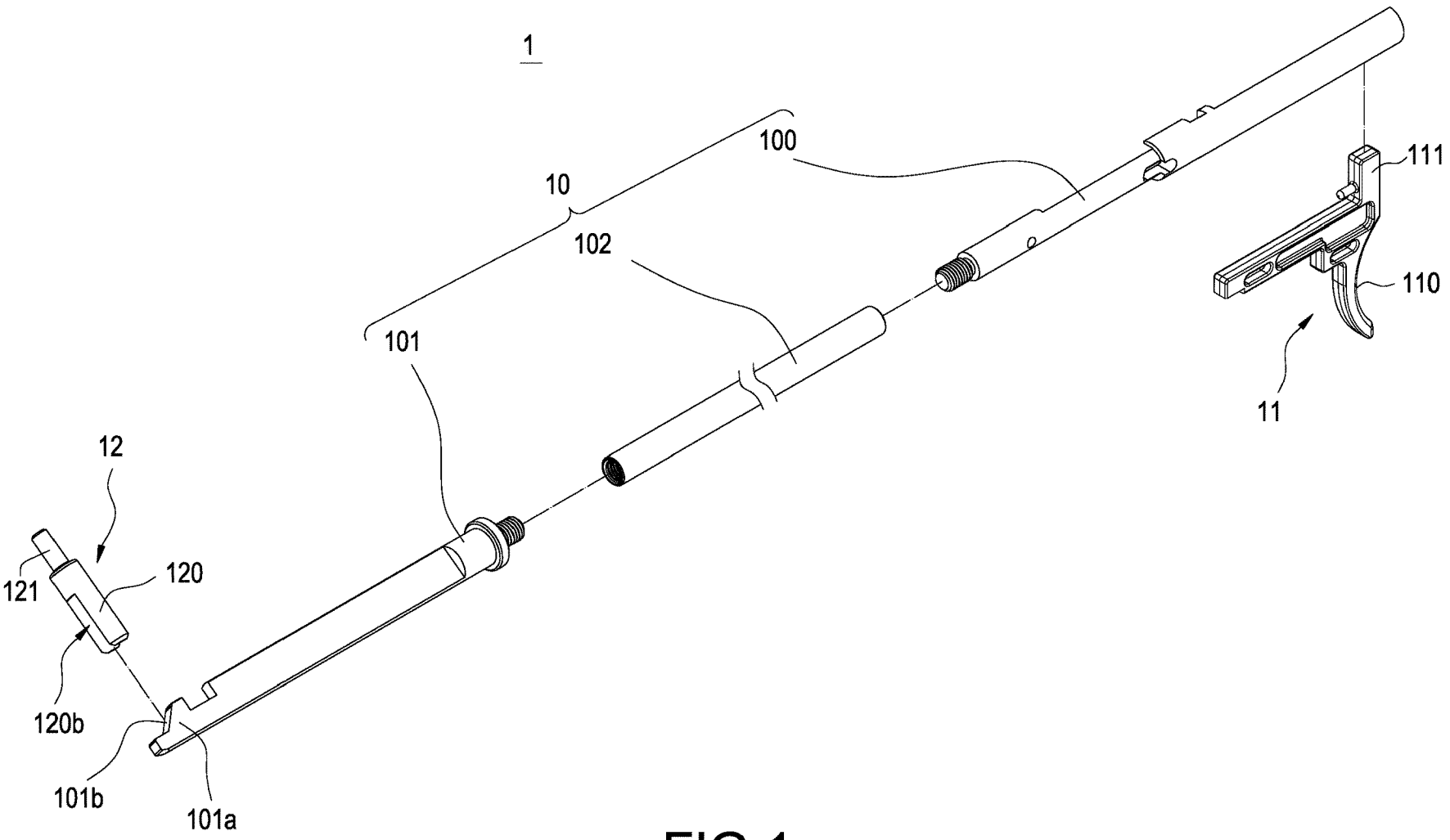
FIG. 1 is an exploded view of the disclosure.
Figure 2:
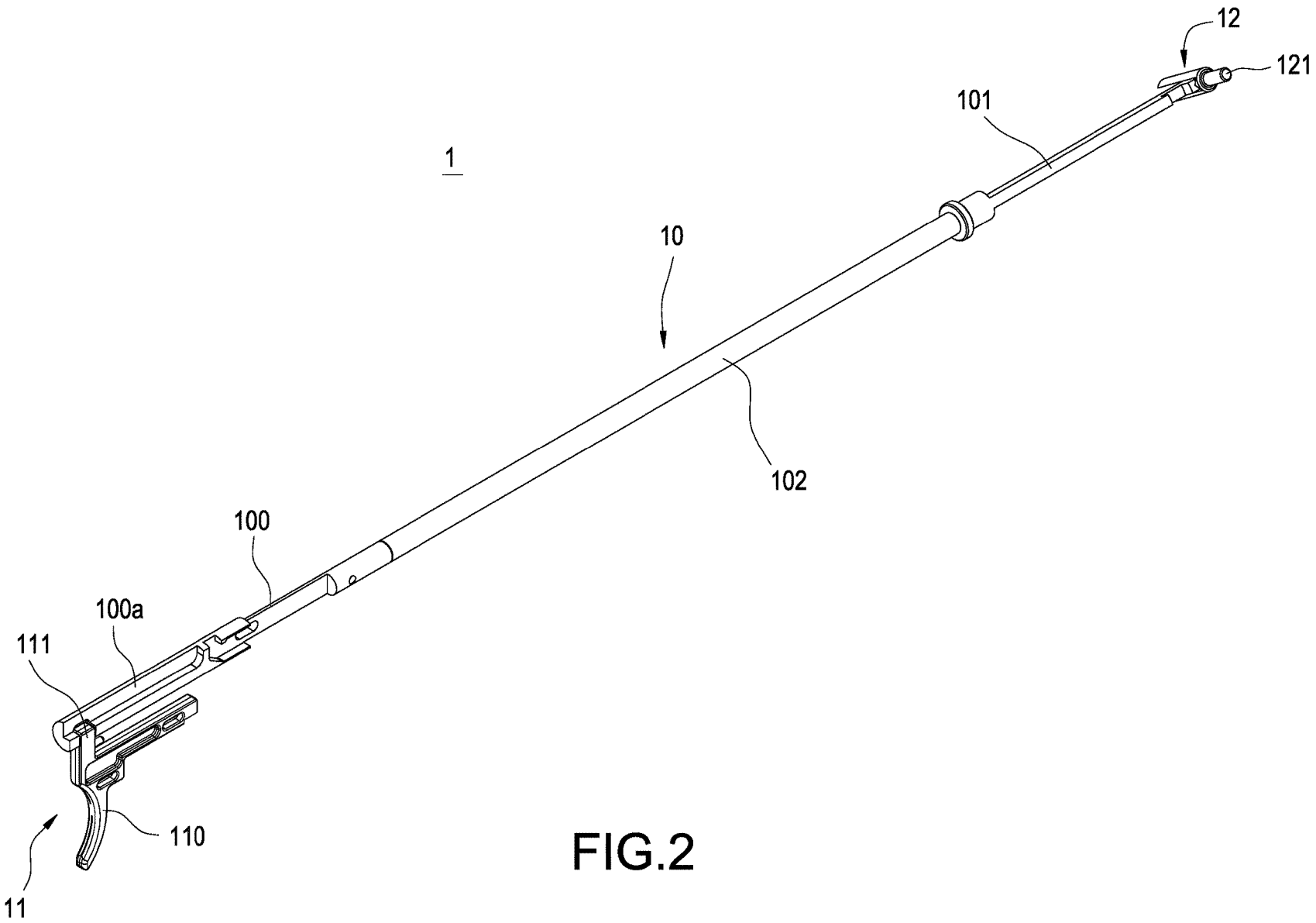
FIG. 2 is an assembled view of the disclosure.
Figure 3:
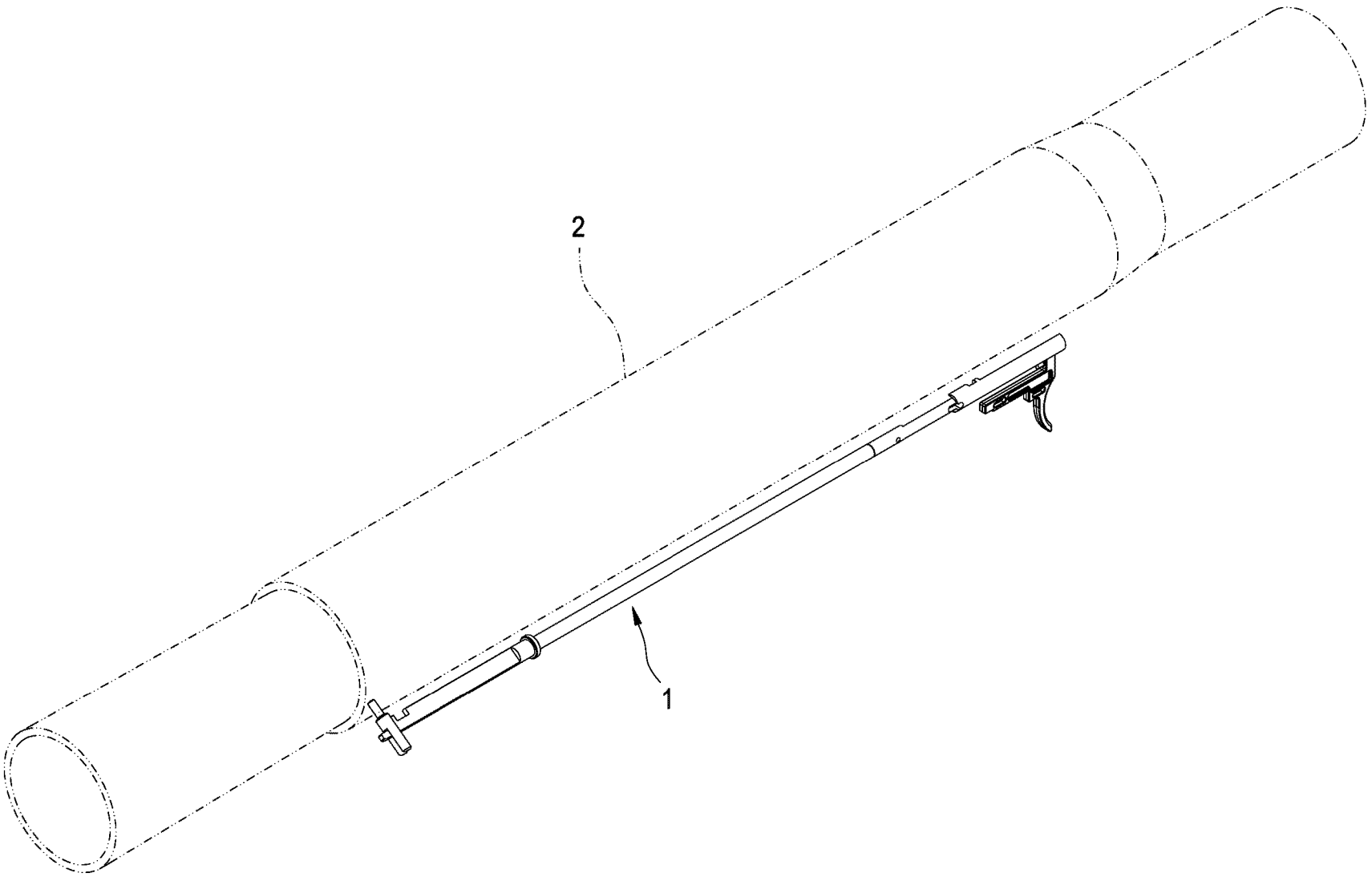
FIG. 3 is a perspective schematic view of the disclosure applied to a barrel.
Figure 7:
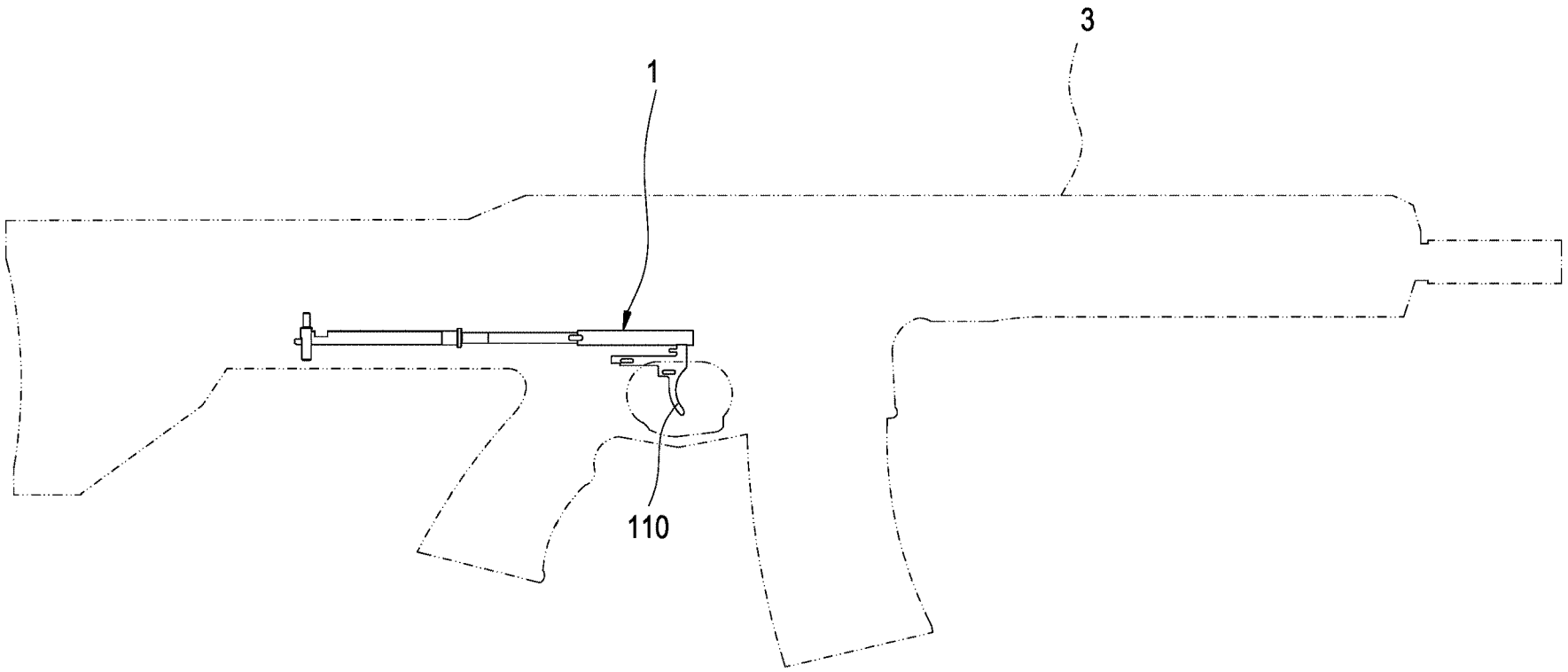
FIG. 7 is a schematic plan view of the disclosure applied to a gun body.

Please refer to FIGS. 1-3, which are an exploded view of the disclosure, an assembled view and a perspective schematic view of the disclosure applied to a barrel. The disclosure provides a firing linkage mechanism 1 of a toy launcher, which is used to be installed to a toy launcher such as a barrel 2 as shown in FIG. 3 or a gun body 3 as shown in FIG. 7 and is arranged to extend along a longitudinal direction of a toy launcher such as a barrel 2 or a gun body 3 to serve as a linkage mechanism 1 of the toy launcher at firing. The disclosure includes a linkage assembly 10, a trigger assembly 11 and a firing assembly 12.

The linkage assembly 10 may be a link (or linkage rod) for connecting between the trigger assembly 11 and the firing assembly 12. In the design of the toy launchers, regardless of matching the appearance design of simulated weapons such as guns, cannons, or independently designed toy weapons, when the distance between the trigger position and the ammunition firing position is greater than the common condition, the linking between the trigger assembly 11 and the firing assembly 12 may be kept by the extension of the linkage assembly 10. In the embodiment, the linkage assembly 10 is installed on an outer surface of the barrel 2, and the linkage assembly 10 may be composed of multiple link sections. The linkage assembly 10 may be divided into a moving end 100, a firing end 101 and an extending section 102 connected between the moving end 100 and the firing end 101 in series, and they may be connected to be a link in a detachable manner by screwing or engagement. A length of the extending section 102 may be adjusted depending on requirements of different products to make the disclosure match more diverse products to increase interchangeability and universality between components.

The trigger assembly 11 is disposed on an end of the linkage assembly 10 and has a trigger portion 110 and a connecting portion 111 disposed on an end of the linkage assembly 10. The trigger portion 110 protrudes from the barrel 2 or the gun body 3 for being pressed by a hand. In the shown embodiment of the disclosure, the trigger assembly 11 is disposed on the moving end 100 of the linkage assembly 10. The moving end 100 may be formed with a connecting trough 100*a*. The connecting portion 111 is disposed in the connecting trough 100*a* to make the trigger assembly 11 move the linkage assembly 10 to make an axially forward or backward movement when the trigger portion 110 is pressed.

The firing assembly 12 is disposed on the other end of the linkage assembly 10 and has a touching portion 120 and a firing portion 121 extended from the touching portion 120.

The firing portion 121 reaches in the barrel 2 or the gun body 3 to be corresponding to the firing mechanism in the toy launcher (not shown in figures) so that the toy launcher may perform the shooting action for the bullets through the firing portion 121 triggering the firing mechanism. In detail, the firing assembly 12 is disposed on the firing end 101 of the linkage assembly 10. The firing end 101 is disposed with an acting portion 101*a* cooperating with the touching portion 120. When the acting portion 101*a* is driven by the axial movement of the linkage assembly 10 to move, the touching portion 120 is driven to make the firing portion 121 implement the firing action. In the shown embodiment of the disclosure, the firing portion 121 moves toward a direction which crosses the axial direction of the linkage assembly 10 such as a radial direction of the linkage assembly 10.

Figure 4:
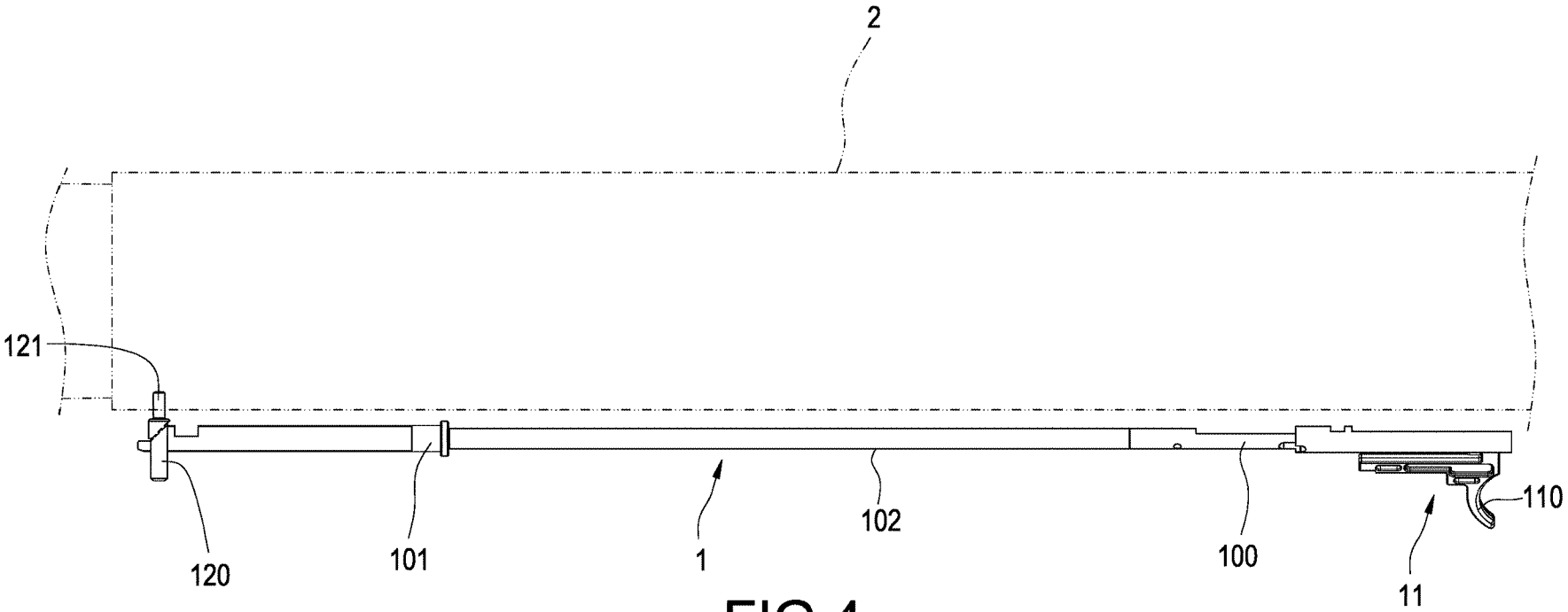
FIG. 4 is a schematic plan view of the disclosure applied to a barrel.
Figure 5:
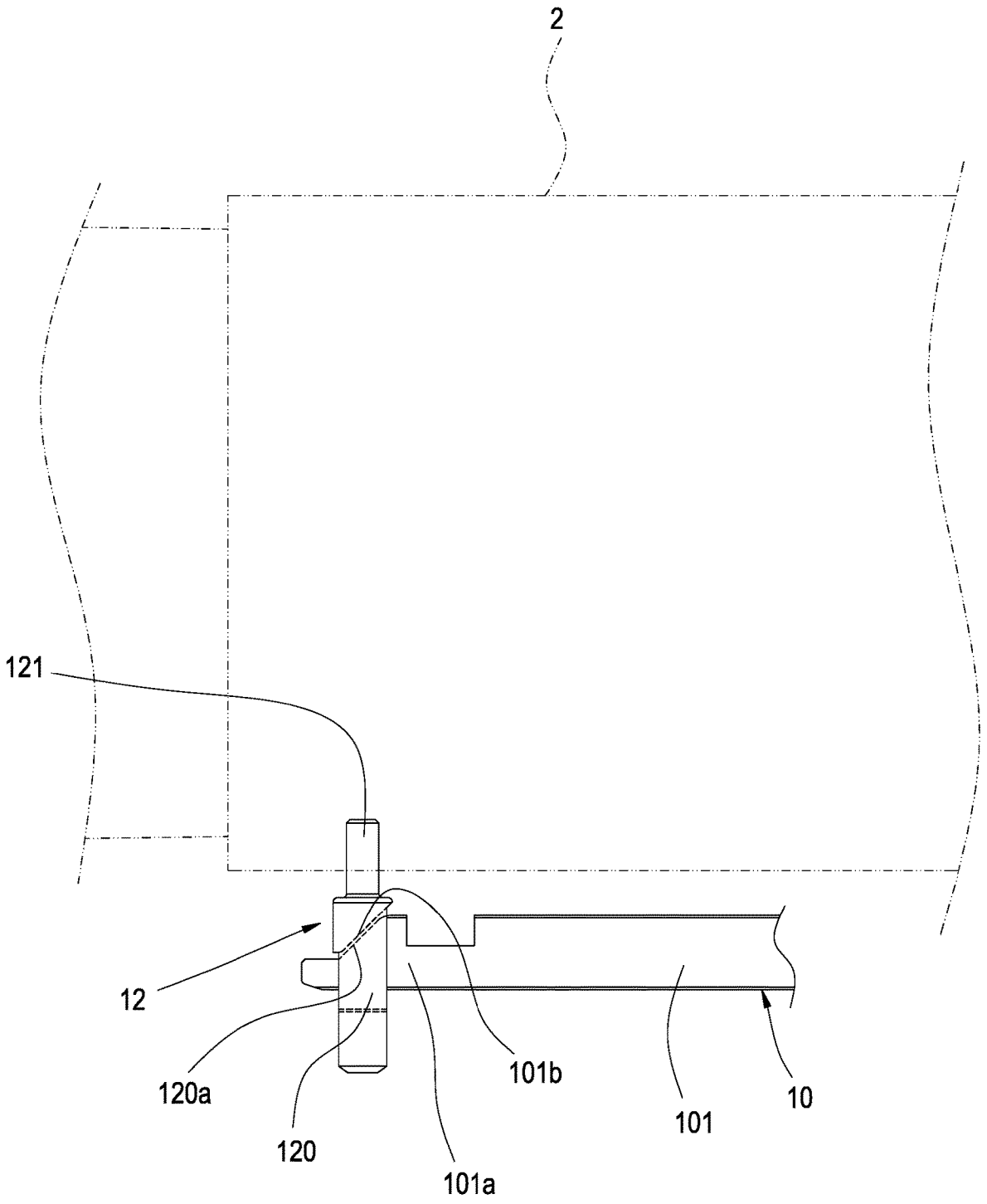
FIG. 5 is a schematic view of local operation of the disclosure applied to a barrel.
Figure 6:
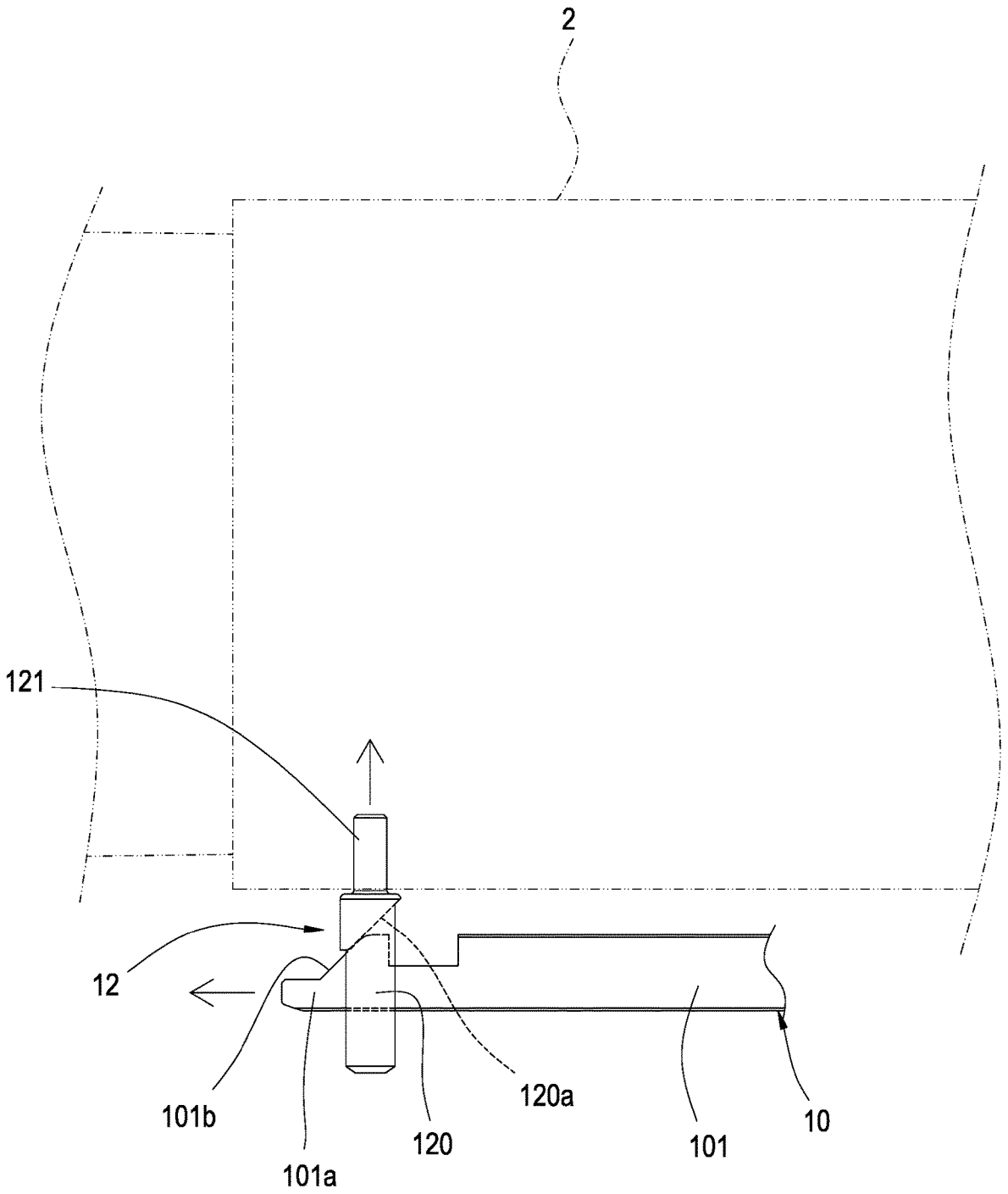
FIG. 6 is another schematic view of local operation of the disclosure applied to a barrel.

As shown in FIGS. 4 and 5, when a user's finger presses the trigger portion 110 of the trigger assembly 11, the connecting portion 111 moves the linkage assembly 10 to make an axially forward or backward movement (in the shown embodiment, the linkage assembly 10 is moved backward) so as to make the acting portion 101*a* on the firing end 101 of the linkage assembly 10 touch the firing portion 121 of the firing assembly 12. In the shown embodiment of the disclosure, the acting portion 101*a* is provided with an acting slant 101*b* and the firing portion 121 is provided with a touching slant 120*a* which slidably contacts the acting slant 101*b*. As shown in FIG. 6, when the acting portion 101*a* moves backward, the firing assembly 12 may move toward its extending direction by the acting slant 101*b* pushing the touching slant 120*a* to make a mutual slide. In other words, the firing portion 121 may make a firing action toward the firing mechanism in the toy launcher to shoot out bullets in the toy launcher.

Please refer to FIG. 1. The touching portion 120 of the firing assembly 12 is formed with a trench 120*b* for being passed by the acting portion 101*a* of the linkage assembly 10, and the touching slant 120*a* is located in the trench 120*b* to make the acting portion 101*a* passing the trench 120*b* be able to use the acting slant 101*b* to slidably contact the touching slant 120*a*.

Figure 8:
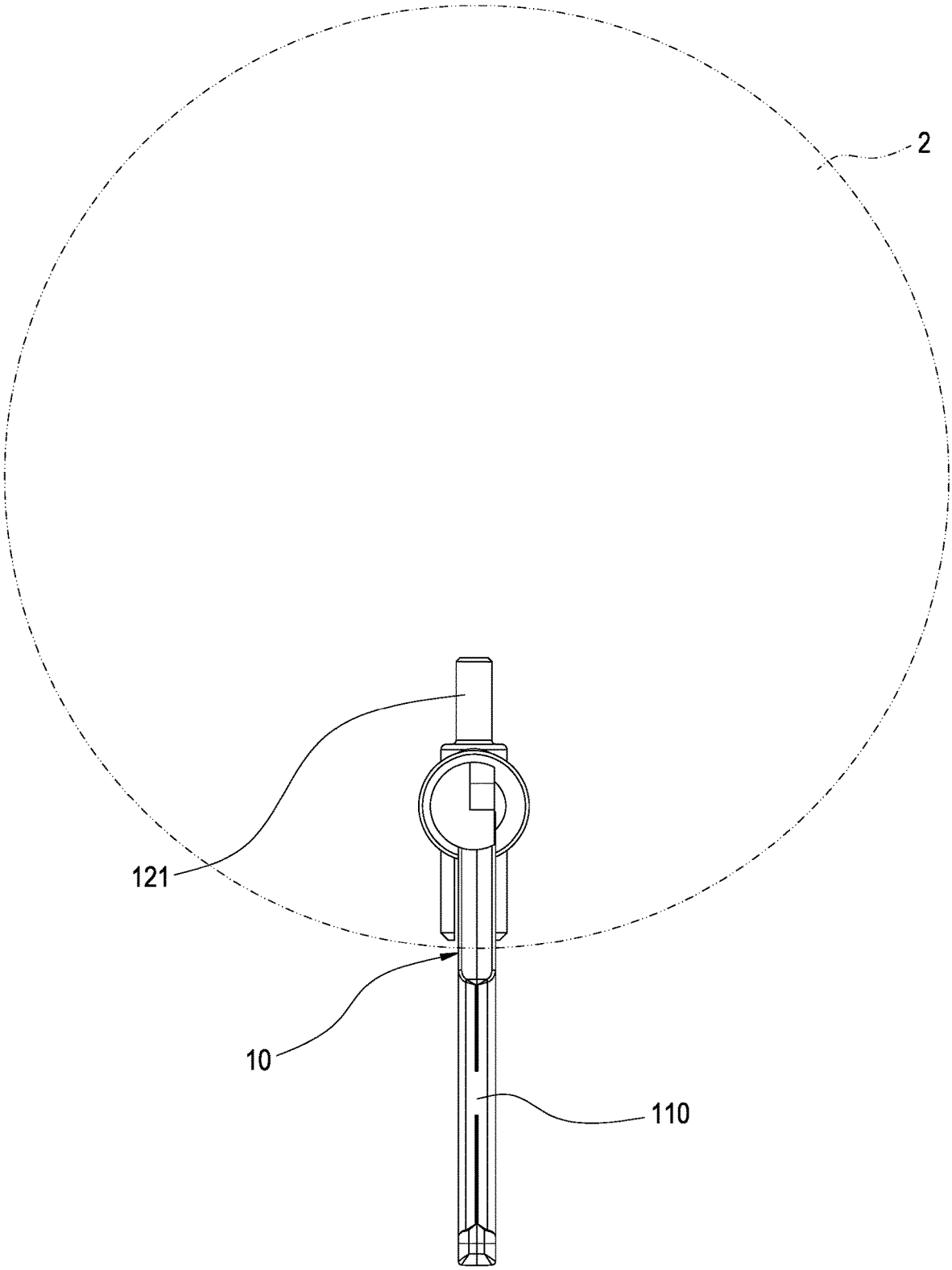
FIG. 8 is a schematic plan view of the disclosure applied to a gun body.
Figure 9:
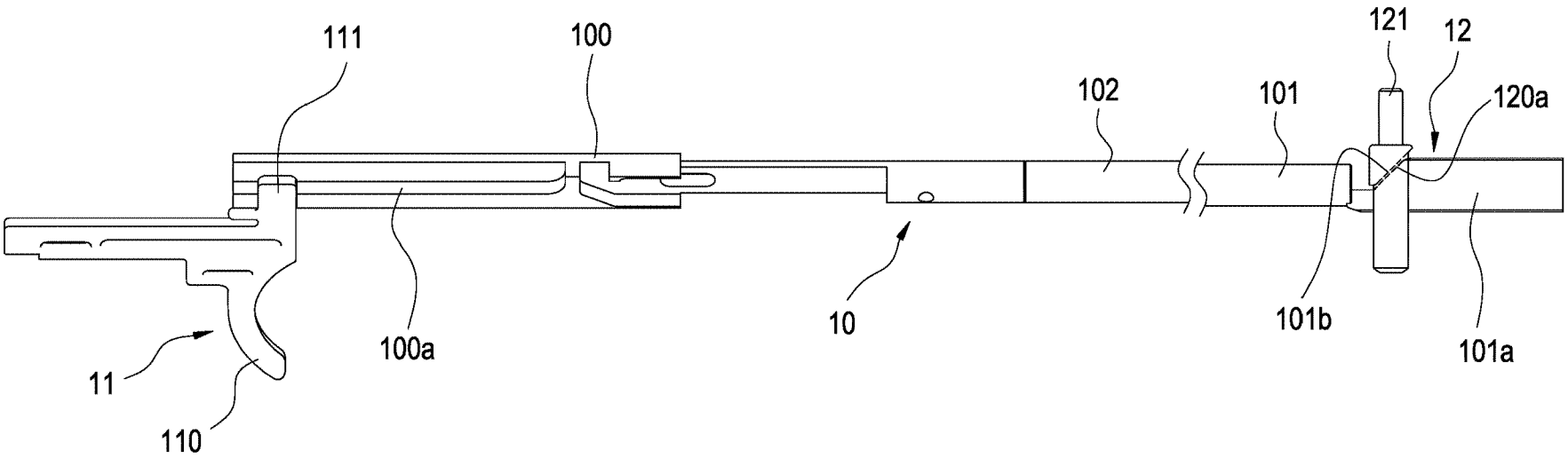
FIG. 9 is a schematic plan view of another embodiment of the disclosure.

In addition, as shown in FIG. 8, the linkage assembly 10 may also be installed on an inner wall of the barrel 2 at a proper position depending on the structure of a barrel or a gun. Further, as shown in FIG. 9, considering the various possibilities of a trigger and a firing position, the firing assembly 12 may be located at front of the trigger assembly 11 (in the above embodiment, the firing assembly 12 is located at back of the trigger assembly 11) to move the firing assembly 12 by an axially forward movement of the linkage assembly 10. As a result, the disclosure may make the moving position and the firing position of a toy launcher be unlimited to make more diverse modifications or changes to match different designs or production models.

Accordingly, by the abovementioned structure, the firing linkage mechanism of the toy launcher of the disclosure may be obtained.

While this disclosure has been described by means of specific embodiments, numerous modifications and variations could be made thereto by those skilled in the art without departing from the scope and spirit of this disclosure set forth in the claims.

What is claimed is:

1. A firing linkage mechanism of a toy launcher, the firing linkage mechanism comprising:

a linkage assembly, comprising a moving end, a firing end, and an extending section detachably connected between the moving end and the firing end in series;

a trigger assembly, disposed on the moving end, comprising a trigger portion and a connecting portion connected with the moving end, and the connecting portion driving the linkage assembly to make an axial movement when the trigger portion is acting; and a firing assembly, disposed on the firing end, and comprising a touching portion and a firing portion extended from the touching portion;

wherein an acting portion is disposed on the firing end of the linkage assembly, the acting portion is configured to cooperate with the touching portion of the firing assembly, and the acting portion is driven by the axial movement of the linkage assembly to move the touching portion to make the firing portion implement a firing action, wherein the acting portion comprises an acting slant, and the firing portion comprises a touching slant slidably contacting the acting slant.

2. The firing linkage mechanism of claim 1, wherein the linkage assembly comprises a link.

3. The firing linkage mechanism of claim 1, wherein the linkage assembly comprises multiple link sections connected in series.

4. The firing linkage mechanism of claim 1, wherein a connecting trough is disposed on the moving end of the linkage assembly, and the connecting portion of the trigger assembly is disposed in the connecting trough.

5. The firing linkage mechanism of claim 1, wherein the touching portion comprises a trench, the touching slant is located in the trench, and the acting portion is configured to make the acting slant slidably contact the touching slant through the trench.

6. The firing linkage mechanism of claim 1, wherein the firing portion moves toward a direction crossing an axial direction of the linkage assembly to implement the firing action.

7. The firing linkage mechanism of claim 6, wherein the direction crossing the axial direction of the linkage assembly is a radial direction of the linkage assembly.

* * * * *